US007534747B2

(12) United States Patent
Burrington et al.

(10) Patent No.: US 7,534,747 B2
(45) **Date of Patent: *May 19, 2009**

(54) GELS THAT REDUCE SOOT AND/OR EMISSIONS FROM ENGINES

(75) Inventors: James D. Burrington, Mayfield Village, OH (US); Herman F. George, Chardon, OH (US); John R. Martin, Concord Township, OH (US); Ralph E. Kornbrekke, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 163 days.

This patent is subject to a terminal disclaimer.

(21) Appl. No.: 10/603,644

(22) Filed: Jun. 25, 2003

(65) Prior Publication Data

US 2004/0266631 A1 Dec. 30, 2004

(51) Int. Cl.
*C10M 159/20* (2006.01)
*C10M 159/12* (2006.01)

(52) U.S. Cl. ..... 508/113; 508/116; 508/136; 508/165; 508/180; 508/287; 508/293; 508/391; 508/460; 508/507; 508/563; 508/584

(58) Field of Classification Search ..... 508/113
See application file for complete search history.

(56) References Cited

U.S. PATENT DOCUMENTS

| | | | | |
|---|---|---|---|---|
| 3,336,223 | A | 8/1967 | Kneeland | 252/9 |
| 3,749,247 | A | 7/1973 | Rohde | 210/205 |
| 3,883,439 | A | 5/1975 | Bergeron | 252/37.2 |
| 4,014,794 | A | 3/1977 | Lewis | 210/199 |
| 4,061,572 | A | 12/1977 | Cohen et al. | 210/168 |
| 4,066,559 | A | 1/1978 | Rohde | 252/10 |
| 4,075,098 | A | 2/1978 | Paul et al. | 210/168 |
| 4,144,166 | A | 3/1979 | DeJovine | 210/60 |
| 4,144,169 | A | 3/1979 | Grueschow | 210/168 |
| 4,601,799 | A | 7/1986 | Froberger et al. | 204/181.8 |
| 4,639,255 | A | 1/1987 | Schuettenberg et al. | 44/62 |
| 4,751,901 | A | 6/1988 | Moor | 123/196 A |
| 4,755,289 | A | 7/1988 | Villani | 210/132 |
| 4,769,167 | A | 9/1988 | Haas et al. | 252/76 |
| 4,906,389 | A | 3/1990 | Brownawell et al. | 252/25 |
| 4,977,871 | A | 12/1990 | Brownawell et al. | 123/196 A |
| 5,032,259 | A | 7/1991 | He et al. | 210/133 |
| 5,042,617 | A | 8/1991 | Brownawell et al. | 184/6.24 |
| 5,059,217 | A | 10/1991 | Arroyo et al. | 44/639 |
| 5,069,799 | A | 12/1991 | Brownawell et al. | 210/749 |
| 5,249,552 | A | 10/1993 | Brooks | 123/1 |
| 5,327,861 | A | 7/1994 | Rogalla et al. | 123/196 S |
| 5,374,354 | A | 12/1994 | Baehler et al. | 210/168 |
| 5,422,022 | A * | 6/1995 | Chamberlin, III | 508/390 |
| 5,435,912 | A | 7/1995 | Baehler et al. | 210/168 |
| 5,456,217 | A | 10/1995 | Thunker et al. | 123/1 A |
| 5,478,463 | A | 12/1995 | Brownawell et al. | 208/180 |
| 5,507,942 | A | 4/1996 | Davis | 210/94 |
| 5,527,452 | A | 6/1996 | Grigoriev et al. | 210/130 |
| 5,552,040 | A | 9/1996 | Baehler et al. | 210/168 |
| 5,573,557 | A | 11/1996 | Thünker et al. | 44/639 |
| 5,580,359 | A | 12/1996 | Wright | 44/321 |
| 5,591,330 | A | 1/1997 | Lefebvre | 210/203 |
| 5,662,799 | A | 9/1997 | Hudgens et al. | 210/192 |
| 5,695,531 | A | 12/1997 | Makino et al. | 44/639 |
| 5,718,258 | A | 2/1998 | Lefebvre et al. | 137/268 |
| 5,725,031 | A | 3/1998 | Bilski et al. | 141/2 |
| 5,767,045 | A | 6/1998 | Ryan | 508/287 |
| 5,776,494 | A | 7/1998 | Guskey et al. | 424/484 |
| 5,837,657 | A * | 11/1998 | Fang et al. | 508/363 |
| 5,897,770 | A | 4/1999 | Hatch et al. | 210/101 |
| 6,008,165 | A | 12/1999 | Shanklin et al. | 508/185 |
| 6,045,692 | A | 4/2000 | Bilski et al. | 210/198.1 |
| 6,140,279 | A * | 10/2000 | Emert et al. | 508/192 |
| 6,187,721 | B1 * | 2/2001 | Goldblatt et al. | 508/221 |
| 6,207,625 | B1 * | 3/2001 | Ogano et al. | 508/365 |
| 6,238,554 | B1 | 5/2001 | Martin, Jr. et al. | 210/109 |
| 6,268,316 | B1 * | 7/2001 | Tanaka et al. | 508/291 |
| 6,310,010 | B1 * | 10/2001 | Higton et al. | 508/192 |
| 6,520,902 | B1 * | 2/2003 | Brown et al. | 494/24 |
| 6,579,218 | B1 * | 6/2003 | May et al. | 494/24 |
| 6,605,571 | B1 * | 8/2003 | Higton et al. | 508/185 |
| 6,689,725 | B1 * | 2/2004 | Gao | 508/364 |
| 6,784,142 | B2 * | 8/2004 | Van Dam et al. | 508/192 |

(Continued)

FOREIGN PATENT DOCUMENTS

EP 0258426 B1 7/1990

(Continued)

OTHER PUBLICATIONS

PCT Search Report for corresponding International Application No. PCT/US2005/026884; date of mailing of search report: Jun. 6, 2005, Published Mar. 2, 2006 as WO 2006/022724.

(Continued)

*Primary Examiner*—Ellen McAvoy
(74) *Attorney, Agent, or Firm*—Christopher D. Hilker; David M. Shold; Teresan W. Gilbert

(57) ABSTRACT

A soot reducing media that reduces the soot content in lubricating oil in an engine. Further a process employing a gel to decrease the amount of soot in the lubricating oil of an engine and/or decrease the emissions from an engine.

21 Claims, No Drawings

U.S. PATENT DOCUMENTS

| | | | | |
|---|---|---|---|---|
| 6,843,916 | B2 * | 1/2005 | Burrington et al. | 210/416.5 |
| 6,860,241 | B2 | 3/2005 | Martin et al. | 123/1 A |
| 7,056,870 | B2 | 6/2006 | Chapaton et al. | 508/208 |
| 7,087,674 | B2 | 8/2006 | Sarkar et al. | 524/560 |
| 7,163,482 | B2 | 1/2007 | Sarkar et al. | 475/159 |
| 7,384,896 | B2 * | 6/2008 | George et al. | 508/291 |
| 2002/0014447 | A1 | 2/2002 | Rohrbach et al. | 210/209 |
| 2002/0043495 | A1 | 4/2002 | Beard et al. | 210/416.1 |
| 2004/0014614 | A1 | 1/2004 | Burrington et al. | 508/287 |
| 2004/0157751 | A1 | 8/2004 | Chapaton et al. | 508/124 |
| 2004/0157970 | A1 | 8/2004 | Sarkar et al. | 524/366 |
| 2004/0159304 | A1 | 8/2004 | Caracciolo | 123/196 R |
| 2004/0266631 | A1 | 12/2004 | Burrington et al. | 508/113 |

FOREIGN PATENT DOCUMENTS

| | | | |
|---|---|---|---|
| EP | 0254776 | B1 | 3/1991 |
| EP | 0416907 | | 3/1991 |
| EP | 0416907 | A2 | 3/1991 |
| EP | 0915730 | B1 | 5/1999 |
| EP | 0962518 | A1 | 12/1999 |
| EP | 1213341 | A1 | 6/2002 |
| WO | WO 94/24237 | | 10/1994 |
| WO | WO 03/018163 | | 3/2003 |
| WO | WO 2005/003255 | | 1/2005 |
| WO | WO 2005/003265 | | 1/2005 |
| WO | WO 2005/003266 | | 1/2005 |

OTHER PUBLICATIONS

"Studies on Combustion, Vibration, and Noise in High-Speed Diesel Engines Through Newly Developed Measuring Instruments" (Journal of Eng. For Gas Turbines and Power, Jul. 1988, vol. 110, pp. 377-384).

"Deliverables Prepared for Lubrizol", R. Kolar and S. Cullen, Cupertino, CA (Aurigin Consulting, Aug. 23, 2001).

"Blending of Alcohols with Diesel Fuels", US/GLO/83/039, E.J. Lom and R.R. Reeves, (U.S. Dept. of Commerce, Natl. Tech. Information Service, Springfield, VA, Jan. 3, 1986, pp. 1-243).

"A Review of Zinc Dialkyldithiophosphates (ZDDPS): Characterisation and Role in the Lubricating Oil", A.M. Barnes, K.D. Bartle, V.R.A. Thibon, Elsevier Science Ltd. (Tribology International 34 [2001], pp. 389-395).

* cited by examiner

GELS THAT REDUCE SOOT AND/OR EMISSIONS FROM ENGINES

BACKGROUND OF THE INVENTION

The present invention relates to a novel gel composition that results in the decrease in the amount of soot in a lubricating oil in an engine and/or decrease the amount of emissions particularly soot, hydrocarbons and/or nitrogen oxides ($NO$, $NO_2$, $N_2O$, collectively known as NOx) from an engine.

Soot may be present in any lubricating oil used in a lubrication system of any engine that generates soot such as internal combustion engines, spark ignited engines, stationary engines, off and on highway engines and the like. Internal combustion engines, in particular diesel fueled engines, generate carbonaceous soot particles. During combustion the fuel is injected into the combustion chamber in the form of small droplets. During the combustion process, soot particles form from incompletely combusted fuel. The lubricating oil for the cylinders and the rings contain the soot from the incomplete combustion. As the pistons move up and down in the chamber, the soot particles that have formed go into the lubricating oil system of the pistons, rings, through the cylinder and into the reservoir. Accordingly, the generated soot in the engine oil contributes to problems with engine lubrication.

Soot is also a problem in modem diesel engines with fuel injection systems. The fuel injection system has been designed to produce less emissions, but has increased the formation of soot in the lubricating oil of the engine. It further requires more frequent oil change intervals to prevent the concentration of soot particles in the oil from exceeding acceptable limits.

The suspended soot particles in the lubricating oil have the effect of increasing the viscosity and creating wear particles in the lubricating oil. Accordingly, the soot acts like an abrasive and induces wear in the engine parts. Further, high soot levels result in shorter drain intervals and more oil changes.

Dispersants have been used in lubricating oils to suspend the soot build up so as to reduce the detrimental effects of the soot on engine wear. However, an oils' capacity to protect an engine is limited, even with the dispersants. In addition, soot particles are small and are finely distributed in the lubricating oil so that filters generally are not satisfactory in removing the soot. During the course of a heavy duty diesel service interval (15,000 to 30,000 miles), 5 to 10 pounds of soot is typically produced. Filtration of the suspended or dispersed soot particles in the lubricating oil is complicated by their small size of generally less than 1 micron compared to typical automotive oil filters, which are sized to remove particles which are 20 to 40 microns or greater in diameter. This level of a soot loading can not be practically filtered with conventional filtration methods.

It is desirable to decrease the concentration of particles of soot in an engine oil using a novel gel composition. It is further desirable to decrease the emissions of soot, hydrocarbons and/or Nox from and engine using a novel gel composition.

It has been found that a gel in contact with lubricating oil of an engine can decrease the soot content in the oil as well as also reducing the emissions from an engine in particular soot, hydrocarbons and/or Nox. It has been further found that an oil based gel can reduce the particles of soot from the oil of an engine and/or from an engines emissions.

SUMMARY OF THE INVENTION

In accordance with the instant invention, it has been discovered that an oil based gel can reduce the concentration of soot particles in a lubricating oil of an engine and/or reduce emissions from an engine.

In accordance with the present invention it has been discovered that a gel composition comprising a dispersant, a detergent, and an antioxidant reduces the concentration of soot in the lubricating oil of an engine and/or decreases the emissions from an engine. The gel dissolves into the oil during use of the engine. In one embodiment the release of the gel components is a slow release.

In the present invention, suspended and/or dispersed soot in engine oil is decreased by a process comprising contacting a portion of an engine oil containing the soot with a gel. Further the present invention decreases the emissions from an engine by a process comprising contacting a portion of an engine oil with a gel.

The present invention provides for the use of a gel to decrease the amount of suspended/dispersed soot in lubricating oil in engines and/or to decrease the emissions in particular soot, hydrocarbons and/or Nox from an engine. The engines that can use the gel include, but are not limited to internal combustion engines, stationary engines, generators, diesel and/or gasoline engines, on highway and/or off highway engines, two-cycle engines, aviation engines, piston engines, marine engines, railroad engines, biodegradable fuel engines and the like. In one embodiment the engine is equipped with after treatment devices, such as exhaust gas recirculation systems, catalytic converters, diesel particulate filters, NOx traps and the like.

DETAILED DESCRIPTION OF THE INVENTION

In accordance with the present invention the soot concentration is decreased from a lubricating oil in an engine thereby avoiding the deleterious effects on the engine from the soot, including viscosity, wear and emissions. Furthermore, the emissions of an engine is decreased thereby improving the environment.

The soot level is reduced by contact with the gel. The gel is positioned within the lubricating system, anywhere the gel will be in contact with the lubricating oil. The gel is positioned anywhere that the circulating oil contacts the gel such as full flow of oil, bypass of the oil in the reservoir or combinations therein. The location of the gel in the lubricating system includes but is not limited to a filter, drain pan, oil bypass loop, canister, housing, reservoir, pockets of a filter, canister in a filter, mesh in a filter, canister in a bypass system, mesh in a bypass system and the like. One or more locations can contain the gel. Further, if more than one gel is used it can be identical, similar and/or a different soot-reducing gel.

In one embodiment it is desirable to provide a container to hold the gel, such as a housing, a canister, a structural mesh or the like anywhere within the lubricating oil system, for example, a filter in a housing of an engine oil lubricating system. The necessary design feature for the container is that at least a portion of the gel is in contact with the oil.

In one embodiment, the gel is positioned anywhere in the filter. The filter is a desirable location to place the gel because the gel and/or spent gel can easily be removed, and then replaced with a new and/or recycled gel.

The gel needs to be in contact with the engine oil, in one embodiment the gel is in contact with the oil in the range of about 100% to about 5% of the oil in the bypass system, in another embodiment the gel is in contact with the oil in the range of about 75% to about 25% of the oil in the bypass system and in another embodiment the gel is in contact with the oil in the range of about 50% of the oil in the bypass system.

The release rate of the gel is determined primarily by the gel formulation. Also the location and the flow rate affects the rate at which the gel dissolves. In one embodiment the gel is positioned in a location of a high flow rate such as about 50% to about 100% of the circulating oil. In another embodiment the gel is positioned in a location of medium flow rate such as about 25% to about 75% of the circulating oil. In another embodiment the gel is positioned in a location of low flow rate such as≦1% to about 25% of the circulating oil. The flow rate of the circulating oil is directly proportional to the dissolution rate of the gel. Therefore as the flow rate decreases there is less dissolution of the gel and as the flow rate increases there is greater dissolution of the gel. The gel is positioned in a location desirable for the specified and desirable dissolution rate of the gel.

In one embodiment the gel's formulation may be composed of one or more components such as oil soluble lubricant additives so that at the end of its service life there is none to little gel residue remaining. In another embodiment the gel's formulation maybe composed one or more component that selectively dissolve while at least a portion of the components remain at the end of its service life.

The gel comprises a dispersant, a detergent, and an antioxidant. Further the gel may optionally contain other lubricant additives.

In one embodiment the gel is represented by the formula A+B+C wherein A equals at least one component with at least one or more reactive or associative groups; wherein B contains a particle(s) or other component(s) with at least one group which reacts or associates with A to form a gel, and wherein C is at least one or more desired lubricant additives. In one embodiment the gel has an antioxidant, a detergent and dispersant.

Component A includes but is not limited to antioxidants; dispersants; ashless dispersants such as Mannich dispersants; succinics; esterfied maleic anhydride styrene copolymers; maleated ethylene diene monomer copolymers; surfactants; emulsifiers; functionalized derivatives of each component listed herein and the like; and combinations thereof. Component A can be used alone or in combination. In one embodiment the preferred A is polyisobutenyl succinimide dispersant.

Component B includes but is not limited to dispersants, detergents, overbased detergents, carbon black, silica, alumina, titania, magnesium oxide, calcium carbonate, lime, clay, zeolites and the like; and combinations thereof. Component B can be used alone or in combination. In one embodiment Component B is an overbased alkybenzenesulfonate detergent.

Component C includes but is not limited to the additives which include but are not limited to antioxidants, extreme pressure (EP) agents, wear reduction agents, viscosity index improvers, anti-foaming agents, mixtures thereof and the like; and combination thereof. Component C can be used alone or in combination. In one embodiment Component C is at least one of an antioxidant and if component A is an antioxidant they are not the same antioxidant.

The gel contains component A in the range of about 0.1% to about 95%, in one embodiment about 5% to about 70% and in another embodiment about 7% to about 50% of the gel. The gel contains component B in the range of about 0.1% and about 99%, in one embodiment about 5% to about 80% and in another embodiment about 10% to about 70% of the gel. The gel contains component C in the range of about 0% to about 95%. In one embodiment about 1% to about 70% and in another embodiment about 5% to about 60% of the gel.

In accordance with the present invention the gel formed is an oil based gel. The gel is selected from the group comprising at least one of dispersants, dispersant precursors (such as alkyl or polymer succinic anhydrides) detergents, antioxidants, and mixtures thereof. Optionally, soluble additives may be added to the gel as desired, in particular oil soluble lubricating additives. The additives include, but are not limited to antioxidants, friction reducing agents, extreme pressure (EP) agents, wear reduction agents, viscosity index improvers, anti-foaming agents, anti-misting agents, cloud-point and pour-point depressants, mineral or synthetic oils, mixtures thereof and the like. The gel typically contains small amounts (about 5-40%) of base stock oils, which include but are not limited to mineral-based, synthetic or mixtures thereof. The gel can be a similar or the same composition as is described in U.S. Pat. Ser. No. 1/019641 entitled "Slow Release Lubricant Additive Gels," assigned to assignee hereof and incorporated herein.

The gel comprises mixtures of two or more substances and exists in a semi-solid state more like a solid than a liquid. The rheological properties of a gel can be measured by small amplitude oscillatory shear testing. This technique measures the structural character of the gel and produces a term called the storage modulus (which represents storage of elastic energy) and the loss modulus (which represents the viscous dissipation of that energy). The ratio of the loss modulus/storage modulus, which is called the loss tangent, or "tan delta," is >1 for materials that are liquid-like and <1 for materials that are solid-like. The gels have tan delta values in one embodiment of about ≦0.75, in one embodiment of about ≦0.5 and in one embodiment of about ≦0.3.

In one embodiment the gels are those in which gelation occurs through the combination of an detergent and dispersant in particular on overbased detergent and ashless succimide dispersed. In this embodiment, the ratio of the detergent to the dispersant is typically from about 10:1 to about 1:10; in one embodiment from about 5:1 to about 1:5; in one embodiment from about 4:1 to about 1:1; and in one embodiment from about 4:1 to about 2:1. In addition, the TBN (total base number) of the overbased detergents is in one embodiment at least 100, in one embodiment at least 300, in one embodiment at least 400 and in one embodiment 600. Where mixtures of overbased detergents are used, at least one should have a TBN value of at least 100. However, the average TBN of these mixtures may also correspond to a value greater than 100.

The dispersants include but are not limited to ashless-type dispersants, polymeric dispersants, Mannich dispersants, high molecular weight (Cn wherein n≧12) esters, carboxylic dispersants, amine dispersants, amine dispersants, polymeric dispersants and combinations thereof. The dispersant may be used alone or in combination. The dispersant is present in the range from about 0.1% to about 95% of the gel, preferably from about 1% to about 70% of the gel, and preferably from about 7% to about 50% of the gel.

The dispersant in the gel includes but is not limited to an ashless dispersant such as a polyisobutenyl succinimide and the like. Polyisobutenyl succinimide ashless dispersants are commercially-available products which are typically made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically containing 1 to 10 ethylene diamine groups per molecule.

Ashless type dispersants are characterized by a polar group attached to a relatively high molecular weight hydrocarbon chain. Typical ashless dispersants include N-substituted long chain alkenyl succinimides, having a variety of chemical structures including typically:

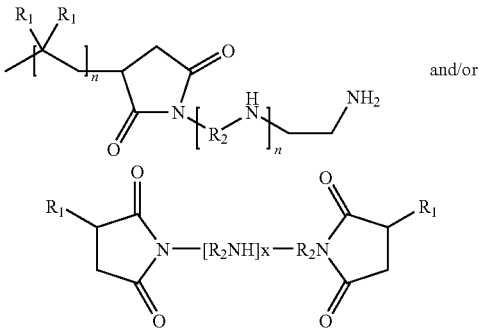

and/or wherein each $R^1$ is independently an alkyl group, frequently a polyisobutyl group with a molecular weight of 500-5000, and $R^2$ are alkenyl groups, commonly ethylenyl ($C_2H_4$) groups. Succinimide dispersants are more fully described in U.S. Pat. No. 4,234,435 which is incorporated herein by reference. The dispersants described in this patent are particularly effective for producing gels in accordance with the present invention.

The Mannich dispersant are the reaction products of alkyl phenols in which the alkyl group contains at least about 30 carbon atoms with aldehydes (especially formaldehyde) and amines (especially polyalkylene polyamines). Mannich bases having the following general structure (including a variety of different isomers and the like) are especially interesting.

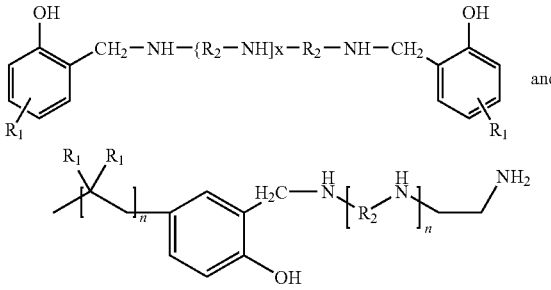

and/or

Another class of dispersants is carboxylic dispersants. Examples of these "carboxylic dispersants" are described in U.S. Pat. No. 3,219,666.

Amine dispersants are reaction products of relatively high molecular weight aliphatic halides and amines, preferably polyalkylene polyamines. Examples thereof are described, in U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Examples of polymer dispersants thereof are disclosed in the following U.S. Pat. Nos. 3,329,658, and 3,702,300.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds.

The detergents include but are not limited to overbased sulfonates, phenates, salicylates, carboxylates, overbased calcium sulfonate detergents which are commercially-available, overbased detergents containing metals such as Mg, Ba, Sr, Na, Ca and K and mixtures thereof and the like. The detergents may be used alone or in combination. Detergents are described, for example, in U.S. Pat. No. 5,484,542 which is incorporated herein by reference. The detergents are present in the range from about 0.1% to about 99%, preferably from about 5% to about 80% and more preferably from about 10% to about 70% by weight of the gel.

Antioxidants include but are not limited to alkyl-substituted phenols such as 2,6-di-tertiary butyl-4-methyl phenol, phenate sulfides, phosphosulfurized terpenes, sulfurized esters, aromatic amines, diphenyl amines, alkylated diphenyl amines and hindered phenols.

The antioxidant includes amine antioxidants and is not limited to bis-nonylated diphenylamine, nonyl diphenylamine, octyl diphenylamine, bis-octylated diphenylamine, bis-decylated diphenylamine, decyl diphenylamine and mixtures thereof.

The antioxidant includes sterically hindered phenols and includes but is not limited to 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylene-bis (2,6-di-tertbutylphenol) and mixtures thereof.

Another example of an antioxidant is a hindered, ester-substituted phenol, which can be prepared by heating a 2,6-dialkylphenol with an acrylate ester under base catalysis conditions, such as aqueous KOH. Antioxidants may be used alone or in combination.

The antioxidants are typically present in the range of about 0.01% to about 95%, preferably about 0.01% to 95%, and more preferably about 1.0% to about 70% and most preferably about 5% to about 60% by weight of the gel.

The extreme pressure anti-wear additives include but are not limited to a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid sulfurized alkylphenol, sulfurized dispentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof. The EP agent can be used alone or in combination.

The EP agents are present in the range of about 0% to 10%, preferably from about 0.25% to about 5% and more preferably from about 0.5% to about 2.5% by weight of the gel.

The antifoams include but are not limited to organic silicones such as poly dimethyl siloxane, poly ethyl siloxane, poly diethyl siloxane and the like. The antifoams may be used alone or in combination. The antifoams are normally used in the range of about 0% to about 1%, preferably about 0.02% to about 0.5% and more preferably 0.05% to about 0.2% by weight of the gel.

The viscosity modifiers provide both viscosity improving properties and dispersant properties. Examples of dispersant-viscosity modifiers include but are not limited to vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers. The viscosity modifiers may be used alone or in combination.

Functionalized polymers can also be used as viscosity modifiers. Among the common classes of such polymers are olefin copolymers and acrylate or methacrylate copolymers. Functionalized olefin copolymers can be, for instance, interpolymers of ethylene and propylene which are grafted with an active monomer such as maleric anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB, methacrylate, polyalkylstyrene, ethylene/propylene and ethylene/propylene/1,4-hexadiene polymers, can also be used as viscosity index improvers.

The viscosity modifiers are known and commercially available. The viscosity modifiers are present in the ranged about 0% to about 20%, preferably about 5% to about 15% and more preferably about 7% to about 10% of the gel.

Optionally, an inert carrier can be used if desired. Furthermore, other active ingredients, which provide a beneficial and desired function to the soot being decreased, can also be included in the gel. In addition, solid, particulate additives such as the PTFE, $MoS_2$ and graphite can also be included.

In an embodiment of this invention, the internal combustion engine is equipped with an exhaust after-treatment device. Exhaust after-treatment devices are used for modern engines to meet the new low exhaust emission standards. These systems are used to reduce undesirable emissions in the exhaust gases of internal combustion vehicle engines and are located in the exhaust system connected to the engines.

In one embodiment of this invention, catalysts are employed in the exhaust systems of internal combustion engines to convert carbon monoxide, hydrocarbons and nitrogen oxides (NOx) produced during engine operation into more desirable gases such as carbon dioxide, water and nitrogen. Among the broad range of available catalysts for this purpose, are oxidation catalysts, reduction catalysts and the so-called three-way converters. Oxidation catalysts can efficiently oxidize unburnt exhaust gas components and convert them into harmless substances. Three-way converters are able to simultaneously convert all three harmful substances provided that the internal combustion engine is operated close to the stoichiometric air/fuel ratio. These catalyst systems typically contain noble metals from the platinum group of the Periodic System of Elements. Particular metals used are platinum, palladium and rhodium.

In another embodiment, the exhaust after-treatment device involves a NOx trap. NOx traps, i.e. materials that are able to absorb nitrogen oxides during lean-burn operation and are able to release them when the oxygen concentration in the exhaust gas is lowered are porous support materials loaded with alkali metal or alkaline earth metals combined with precious metal catalysts such as platinum and the like.

In still another embodiment, the exhaust after-treatment device contains a diesel engine exhaust particulate filter hereinafter referred to as "DPF's". DPF's have a multiplicity of interconnected thin porous walls that define at least one inlet surface and one outlet surface on the filter and a multiplicity of hollow passages or cells extending through the filter from the inlet surface to an outlet surface. The interconnected thin porous walls allow the fluid to pass from the inlet surface to the outlet surface while restraining a desired portion of the solid particulates in the fluid from passing through. DPF's are typically installed in a housing which is inserted like a muffler or catalytic converter into the exhaust system of diesel engine equipped vehicle.

SPECIFIC EMBODIMENTS

EXAMPLES

In order to more thoroughly illustrate the present invention, the following examples are provided.

A. Gel Preparation

A representative gel, known as Composition X is prepared by first mixing components A and C, and then adding component B with mixing in the proportions listed below. The resulting mixture is heated at 120° overnight to produce the final gel.

| Component | Chemical Description | % wt of Composition X |
|---|---|---|
| A | Polyisobutenyl (2000 Mn) succinimide Dispersant | 20% |
| B | 400 TBN Overbased Alkylbenzenesulfonate Deteregent | 60% |
| C | Nonylated Diphenylamine Antioxidant | 20% |

B. Fleet Test

Test Vehicles

The test involved two trucks. Each truck uses two full-flow oil filters.

Test Filters

For the experiment runs, each engine was equipped with a filter with one cup into which was placed 400 g of Composition X additive gel and placed at the bottom of the filter. In the comparative runs, the same filter was used without additive gel in the cup. The additizing cup had twelve of ¼" diameter diffusion holes at the top of the cup above the surface of the gel for 13 experiment—34 experiment runs (Tables 2 and 3) and twelve of 1/16" diameter diffusion holes for experiment runs 1-12 (Table 1).

Test Oil

A 15W40 fully qualified (SAE-CI-4) oil was used in this test.

Test Procedure

The test vehicles was operated for 4 runs: 1) a baseline with standard filters, 2) a test run with two large hole cup filters on Truck #1 and two small-hole filters on Truck #2, 3) a second test run with two large hole cup filters on Truck #2 and two small-hole filters on Truck #1, and #4) a repeat baseline. For each run, both filters was replaced with new standard filters (Runs 1, and 4) or test filters (Runs 2 and 3). A 4-ounce sample was taken at the following mileages:

Each oil change included two flushes in which full sump quantity of new test oil and a new filter was installed, the engine was running for at least 15 minutes, and the oil drained for 30 minutes or until no more oil drips out (whichever occurred first). The two flushes were performed prior to filling with the test oil and installing a new (or test) filter, which remained on the vehicle for the next drain interval.

Oil drain samples were taken for baselines at the mileage intervals from 500-20,000 miles Initial (after vehicle is warmed up) 500 miles, 3,000 miles, 6,000 miles, 9,000 miles, 12,000 miles, and 20,000 miles.

At the 20,000-mile mark, before taking a baseline oil drain sample, test oil was flushed and oil changed and a new filter, was added, additized filter installed and initial additized filter drained.

The following analysis was performed and kinematic viscosity and 100° C. (vis 100); elemental analysis by ICP, ASTM D 4739 (TBN), ASTM D664A (TAN) and percent soot by thermal gravimetric analysis (TGA).

Results

The test results are shown in Tables 1, 2 and 3 for two separate trucks (#1 and #2 respectively), each equipped with Detroit Diesel Series 60 Engines, model year 2000. Experiments 1Comparatives-32 Comparatives are comparative runs without any additive gel (from A above) added to the filter. Experiments 1Experimental-34 Experimental are for trucks equipped with gel additive in the filters. Table 3*a* is the emissions measured for a truck run on an additizing filter vs. a non-additizing filter. The emissions testing was performed with the DOES2 in-use mobile emissions system. This system will have the ability to make a quantitative assessment of HC, NOx, CO, $CO_2$, and TPM emissions when the vehicle is run under a simulated duty cycle. Each run ran for a total of 23 minutes. Top speed on the test route was 50 mph. The duty cycle consisted of the following:

Initial idling for 2 minutes,

Followed by an 18 minute driving sequence,

Concluding with idling the vehicle for 3 minutes.

TABLE 1

Truck 1 Comparative (w/o gel) and Experimental (w/gel) Runs

| Experiment Number | Vehicle # | Oil Miles | % Soot | Vis100 | Experiment Number | Vehicle # | Oil Duration | % Soot | Vis100 |
|---|---|---|---|---|---|---|---|---|---|
| 1 Comp | 1 | 0 | 0.00 | 14.88 | 1 Exp | 1 | 0 | 0.10 | 14.42 |
| 2 Comp | 1 | 554 | 0.10 | 13.69 | 2 Exp | 1 | 573 | 0.20 | 13.42 |
| 3 Comp | 1 | 1,038 | 0.20 | 13.41 | 3 Exp | 1 | 1,069 | 0.10 | 13.09 |
| 4 Comp | 1 | 2,349 | 0.30 | 12.78 | 4 Exp | 1 | 2,754 | 0.20 | 12.38 |
| 5 Comp | 1 | 5,147 | 0.90 | 12.42 | 5 Exp | 1 | 5,279 | 0.30 | 11.87 |
| 6 Comp | 1 | 7,638 | 1.30 | 13.00 | 6 Exp | 1 | 7,408 | 0.60 | 11.60 |
| 7 Comp | 1 | 9,616 | 1.60 | 13.99 | 7 Exp | 1 | 9,668 | 0.80 | 11.85 |
| 8 Comp | 1 | 12,861 | 2.20 | 12.30 | 8 Exp | 1 | 12,818 | 0.90 | 13.64 |
| 9 Comp | 1 | 14,740 | 2.20 | 12.32 | 9 Exp | 1 | 15,831 | 0.90 | 12.79 |
| 10 Comp | 1 | 17,239 | 2.40 | 12.46 | 10 Exp | 1 | 18,306 | 1.00 | 11.80 |
| 11 Comp | 1 | 19,482 | 2.70 | 12.35 | 11 Exp | 1 | 20,173 | 1.20 | 11.87 |
| 12 Comp | 1 | 22,204 | 3.00 | 12.43 | | | | | |

TABLE 2

Truck 2 Comparative (w/o gel) and Experimental (w/gel) Runs

| Experiment Number | Vehicle # | Oil Duration | % Soot | Vis100 | Experiment Number | Vehicle # | Oil Duration | % Soot | Vis100 |
|---|---|---|---|---|---|---|---|---|---|
| 13 Comp | 2 | 0 | 0.00 | 14.88 | 13 Exp | 2 | 0 | 0.10 | 13.97 |
| 14 Comp | 2 | 507 | 0.10 | 13.97 | 14 Exp | 2 | 550 | 0.10 | 13.76 |
| 15 Comp | 2 | 986 | 0.20 | 13.29 | 15 Exp | 2 | 1,024 | 0.10 | 13.11 |
| 16 Comp | 2 | 2,645 | 0.20 | 12.92 | 16 Exp | 2 | 2,399 | 0.10 | 12.58 |
| 17 Comp | 2 | 5,083 | 0.60 | 12.46 | 17 Exp | 2 | 4,375 | 0.20 | 17.24 |
| 18 Comp | 2 | 6,982 | 0.90 | 12.08 | 18 Exp | 2 | 7,051 | 0.40 | 11.88 |
| 19 Comp | 2 | 9,539 | 1.30 | 10.90 | 19 Exp | 2 | 9,728 | 0.70 | 11.63 |
| 20 Comp | 2 | 11,712 | 1.60 | 12.16 | 20 Exp | 2 | 12,036 | 0.80 | 11.76 |
| 21 Comp | 2 | 14,209 | 1.70 | 12.05 | 21 Exp | 2 | 14,904 | 1.00 | 11.74 |
| 22 Comp | 2 | 16,714 | 1.80 | 12.35 | 22 Exp | 2 | 18,129 | 0.90 | 11.97 |
| 23 Comp | 2 | 19,048 | 2.10 | 14.32 | 23 Exp | 2 | 20,224 | 1.10 | 12.02 |

TABLE 3

Second set of Truck 2 Comparative (w/o gel) and Experimental (w/gel) Runs

| Experiment Number | Vehicle # | Oil Duration | % Soot | Vis100 | Experiment Number | Vehicle # | Oil Duration | % Soot | Vis100 |
|---|---|---|---|---|---|---|---|---|---|
| 24 Comp | 2 | 0 | 0.10 | 14.95 | 24 Exp | 2 | 0 | 0.20 | 14.85 |
| 25 Comp | 2 | 573 | 0.10 | 13.65 | 25 Exp | 2 | 547 | 0.10 | 13.86 |
| 26 Comp | 2 | 1,236 | 0.10 | 13.04 | 26 Exp | 2 | 968 | 0.10 | 13.66 |
| 27 Comp | 2 | 4,632 | 0.40 | 13.02 | 27 Exp | 2 | 3,021 | 0.20 | 12.70 |
| 28 Comp | 2 | 6,632 | 0.80 | 12.12 | 28 Exp | 2 | 5,462 | 0.20 | 14.70 |
| 29 Comp | 2 | 9,283 | 1.00 | 12.10 | 29 Exp | 2 | 7,977 | 0.10 | 12.30 |
| 30 Comp | 2 | 11,881 | 1.20 | 12.48 | 30 Exp | 2 | 10,279 | 0.10 | 12.06 |
| 31 Comp | 2 | 14,272 | 1.40 | 12.44 | 31 Exp | 2 | 12,808 | 0.30 | 12.04 |
| 32 Comp | 2 | 16,427 | 1.60 | 12.40 | 32 Exp | 2 | 15,552 | 0.40 | 11.98 |
| 33 Comp | 2 | 19,529 | 1.81 | 12.50 | 33 Exp | 2 | 18,347 | 0.50 | 12.12 |
| 34 Comp | 2 | 24,110 | 2.22 | 12.54 | 34 Exp | 2 | 20,903 | 0.70 | 12.24 |

TABLE 3a

Emissions for a Truck at EOT (20,000 miles) using an additizing vs. a Non-additizing filter.

| | HC (g/ltr fuel) | NOx (g/ltr fuel) | CO (g/ltr fuel) | CO2 (g/ltr fuel) | TPM (g/ltr fuel) | Fuel (ltr/run) |
|---|---|---|---|---|---|---|
| Used (2.2% soot)/Std | 0.92 | 19.58 | 3.33 | 2546.3 | 0.62 | 6.34 |
| Used (1.4% soot)/Gel | 0.86 | 19.12 | 3.35 | 2560.5 | 0.56 | 6.45 |
| % Change | −6.1% | −2.4% | +0.3% | +0.6% | −9.0% | +1.8% |

C. GM 6.5L Engine Test

Test Engine

GM 6.5L Engine see ASTM D5966.

Test Filters

For the Exp runs, each engine was equipped with a filter with one cup into which was placed 400 g of Composition X additive gel and placed at the bottom of the filter. In the comparative runs, the same filter was used without additive gel in the cup. The additizing cup had twelve of ¼" diameter diffusion holes at the top of the cup above the surface of the gel.

Test Oil

A 15W40 fully qualified (SAE-CI-4) oil was used in this test.

Procedure

See Designation: D 5966-99 "Standard Test Method for Evaluation of Engine Oils for Roller Follower Wear in Light-Duty Diesel Engine 1, AMERICAN SOCIETY FOR TESTING AND MATERIALS, 100 Barr Harbor Dr., West Conshohocken, Pa. 19428, from the Annual Book of ASTM Standards. Copyright ASTM.

Results

The results are shown in Table 4, 35comparatives-37 comparatives is for comparative runs with no additive in the filter, experiments 35 experimental-36 experimental are for filters with gel. Table 5 summarizes experiments in which the antioxidants withheld from the gel (37 Experimental) compared to baselines (37Comparatives). Table 6 shows soot production with no gel in the filter, with and without dosing of a 1:1 mixture of antioxidant:dispersant throughout the 50 hr test. These data show that antioxidant and dispersant do not have to be added from the gel, but dosing of these components by other means also results in reduced soot levels in the engine oil.

TABLE 4

GM 6.5 L Test Stand Soot Levels and Kinematic Viscosities @ 100-C w/o (Comparatives) without (35-37 Comparatives) and with 35-36 Experimental) Additive Gel Filter as a Function of Test Hours

| | | Hours on Test | | | | | | |
|---|---|---|---|---|---|---|---|---|
| Experiment | | 0 | 10 | 20 | 25 | 30 | 40 | 50 |
| 35 Comp | % C, Baseline | 0.00% | 0.60% | 1.40% | 1.70% | 1.70% | 2.30% | 2.9% |
| 35 Comp | Vis-Baseline | 13.51 | 14.29 | 15.11 | 15.73 | 16.4 | 17.34 | 18.36 |
| 35 Exp | % C, Gel Filter | 0.10% | 0.40% | 1.20% | 1.60% | 1.60% | 2.10% | 2.60% |
| 35 Exp | Vis-Gel Filter | 14.05 | 15.08 | 15.28 | 14.13 | 17.07 | 17.06 | 17.4 |
| 36 Comp | % C baseline 2 | 0.00% | 0.70% | 1.50% | 1.80% | 2% | 2.50% | 3.20% |
| 36 Comp | Vis baseline 2 | 14.06 | 15.17 | 15.88 | 17.43 | 14.44 | 18.48 | 18.57 |
| 36 Exp | % C exp 2 | 0.10% | 0.20% | 1.00% | 1.40% | 1.5% | 2.00% | 2.50% |
| 36 Exp | Vis exp 2 | 12.06 | 14.98 | 15.26 | 16.74 | 16 | 17.9 | 17.01 |
| 37 Comp | % C baseline 3 | 0.00% | 0.40% | 1.20% | 1.60% | 1.70% | 2.20% | 2.80% |
| 37 Comp | Vis baseline 3 | 13.06 | 14.37 | 15.34 | 15.27 | 16.29 | 16.32 | 16.69 |

TABLE 5

GM 6.5 L Test Soot Production as a Function of Dosing with Gel Components

| Experiment | | Hours on Test 0 | 10 | 20 | 25 | 30 | 40 | 50 |
|---|---|---|---|---|---|---|---|---|
| 37 Comp | % C baseline 3 | 0.0% | 0.4% | 1.2% | 1.6% | 1.7% | 2.2% | 2.8% |
| 37 Exp | % C Gel (-AO) in filter | 0.1% | 0.3% | 1.2% | 1.5% | 1.6% | 2.1% | 2.7% |

*100 g alkyldiphenylamine antioxidant added at beginning of test per 7 qts of oil

TABLE 6

GM 6.5 L Test Soot Production as a Function of Dosing with Gel Components

| Experiment | | Hours on Test 0 | 10 | 20 | 25 | 30 | 40 | 50 |
|---|---|---|---|---|---|---|---|---|
| 38 Exp | % C 1:1 AO:Disp Dosed** | 0.1% | 0.8% | 1.5% | 1.9% | 2.0% | 2.6% | 3.3% |
| 38 Comp | % C Baseline 4 | 0.1% | 0.8% | 1.8% | 2.2% | 2.2% | 3.0% | 3.6% |

**11.3 g of 1:1 (wt) mixture of antioxidant (AO) and dispersant (Disp) per 7 quarts of oil added at 0, 10, 20, 30 and 40 hrs.

D. Mack T-8 Engine Test

Test Engine

Mack T-8 Diesel Engine.

Test Filters

For the experiment runs, the engine was equipped with an oil pan with a 1" deep tray, into which was placed 400 g of Composition X additive gel. In the comparative runs, an oil pan without additive was used.

Test Oil

A 15W40 fully qualified (SAE-CI-4) oil was used in this test.

Procedure

A Short T-8 test was used. The Short T-8 is a modified version of the T-8/T-8E ASTM test. Conditions are shown below:

Speed (rpm): 1800 Fuel Flow (kg/hr): 63.3 Intake Manifold Temp. (C): 43

Coolant Temp. (C): 85 Crankcase Pressure (kPa): 0.25-0.75

Inlet Air Restriction (kPa): 2.25-2.75 Exhaust Back Pressure (kPa): 3.1

Engine Timing (BTDC): 15 degrees

The engine timing corresponds to an average soot production rate in the Comp experiment of 0.006%/hour in a 7 quart oil sump.

Results

The results are shown in Table 7, Experiments 39 Comparatives and 39 Experimental.

From the above description and examples of the invention those skilled in the art will perceive improvements, changes and modifications in the invention. Such improvements, changes and modifications within the skill of the art are intended to be covered by the appended claims.

We claim:

1. A composition comprising one or more lubricant additives in a form of a gel wherein the gel is represented by the formula A+B+C wherein the components A and B interact to form a gel and component C is contained within the gel; wherein the gel is semi-solid; wherein the weight ratio of component A to component B is from about 1:4 to about 1:2; wherein A is selected from the group consisting of antioxidants, dispersants, succinics, maleic anhydride styrene copolymers, maleated ethylene diene monomer copolymers, surfactants, emulsifiers, functionalized derivatives of such components and combinations thereof; wherein B is selected from the group consisting of dispersants, detergents, overbased detergents, carbon black, silica, alumina, titania, magnesium oxide, calcium carbonate, lime, clay, zeolites and combinations thereof; and wherein C is selected from the group consisting of antioxidants, extreme pressure agents, wear reduction agents, viscosity index improvers, anti-foaming agents and combinations thereof; and wherein the gel dissolves into a lubricating oil of a lubricating oil engine over time; and wherein the gel components are controlled released and used in an application selected from the group consisting of decreasing the amount of soot in the lubricating oil of an engine, decreasing the amount of emissions in the engine

TABLE 7

Mack T-8 Test Stand Soot Levels (Comp) without (39 Comparatives) and with 39 Experimental Additive Gel Filter as a Function of Test Hours

| Experiment | | Hours on Test 0 | 7 | 8 | 10 | 14 | 20 | 23 | 24 | 31 | 32 | 39 | 40 | 48 | 56 | 64 |
|---|---|---|---|---|---|---|---|---|---|---|---|---|---|---|---|---|
| 39 Comp | % C, Baseline | 0.05% | 0.06% | | | 0.09% | | 0.14% | | 0.22% | | 0.28% | | | | |
| 39 Exp | % C, Gel oil pan | 0.05% | | | 0.07% | | 0.08% | | | | 0.12% | 0.21% | | | | |

exhaust and combinations thereof; wherein the composition has a tan delta value of ≦0.75.

2. The composition of claim 1 wherein the gel comprises a dispersant, a detergent and an antioxidant and wherein the emissions reduced are selected from the group consisting of soot, NOx, hydrocarbons and combinations thereof.

3. The composition of claim 1 wherein component A is in the range of about 0.1% to about 95% of the gel.

4. The composition of claim 1 wherein component B is in the range of about 0.1% of about 99% of the gel.

5. The composition of claim 1 wherein component C is in the range of about 0% to about 95% of the gel.

6. The composition of claim 1 wherein component B comprises an overbased detergent and component A comprises an ashless succimide dispersant.

7. The composition of claim 6 wherein the total base number (TBN) of the overbased detergent is in the range from about 100 to about 400.

8. The composition of claim 2 wherein, the dispersant is selected from the group consisting of ashless succinimide, polyisobutenyl succinimide, substituted long chain alkenyl succinimides, high molecular weight esters, mannich dispersants, N-substituted long chain alkenyl succinimides, carboxylic dispersants, amine dispersants, polymeric dispersants, decyl methacrylate, vinyl decyl ether, aminoalkyl acrylates, acrylamides, poly-(oxyethylene)-substituted acrylates, high molecular weight olefins with monomers containing polar substitutes and a mixtures thereof; and a detergent selected from the group consisting of overbased sulfonates, phenates, salicylates, carboxylates, overbased calcium sulfonate detergents, overbased detergents containing metals such as Mg, Ba, Sr, Na, Ca and K and mixtures thereof; and an antioxidant selected from the group consisting of alkyl-substituted phenols, 2,6-di-tertiary butyl-4-methyl phenol, phenate sulfides, phosphosulfurized terpenes, sulfurized esters, aromatic amines, diphenyl amines, alkylated diphenyl amines, hindered phenols, bis-nonylated diphenylamine, nonyl diphenylamine, octyl diphenylamine, bis-octylated diphenylamine, bis-decylated diphenylamine, decyl diphenylamine, 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylene-bis(2,6-di-tertbutylphenol) and mixtures thereof.

9. A process comprising contacting a portion of a lubricating engine oil of an engine with a composition comprising two or more lubricant additives in a form of a gel, wherein the gel is represented by the formula A+B+C, wherein the components A and B interact to form a gel and component C is contained within the gel; wherein the weight ratio of component A to component B is from about 1:4 to about 1:2; wherein component A is selected from the group consisting of antioxidants, dispersants, succinics, maleic anhydride styrene copolymers, maleated ethylene diene monomer copolymers, surfactants, emulsifiers, functionalized derivatives of such components and combinations thereof; wherein component B is selected from the group consisting of dispersants, detergents, overbased detergents, carbon black, silica,, alumina, titania, magnesium oxide, calcium carbonate, lime, clay, zeolites and combinations thereof; wherein component C is selected from the group consisting of antioxidants, extreme pressure agents, wear reduction agents, viscosity index improvers, anti-foaming agents and combinations thereof; and wherein the composition has a tan delta value of ≦0.75; resulting in the reduction of soot in the engine oil and/or emissions in an engine exhaust.

10. The process of claim 9 wherein the gel is positioned to contact the oil in an area comprising full flow oil, bypass of oil, in the reservoir and combinations thereof.

11. The process of claim 9 wherein the gel is located in an area comprising a filter, a drain pan, an oil bypass loop, a canister, a housing, a reservoir, a pocket of a filter, a canister in a filter, a mesh in a filter, a canister in a bypass system, a mesh in a bypass system and combinations thereof.

12. The process of claim 9 wherein the gel is in contact with the engine oil in the range of about 100% to 5% of the engine oil.

13. The process of claim 9 wherein the gel is positioned in a location of flow rate of the engine oil in the range of greater than 1% to about 100% of the circulating engine oil.

14. The process of claim 9 wherein the gel at the end of its service life contains a range of none to a portion of the components in the gel remaining at the end of the service life of the gel due to selective dissolution of the gel.

15. The process of claim 9 wherein the emissions reduced in the exhaust comprise soot, Nox, hydrocarbons and combinations thereof.

16. The process of claim 9 comprising adding to the engine oil at the same time all or a portion of the components of the gel.

17. The process of claim 9 comprising adding to the engine oil the components of the gel in portions to the engine oil over its service life.

18. The process of claim 9 comprising adding to the engine oil the components continuously to the engine oil over the service life of the oil.

19. A process comprising adding to the engine oil all or a portion of a composition comprising two or more lubricant additives in a form of a gel, wherein the gel is a semi-solid and wherein the gel is represented by the formula A+B+C, wherein the components A and B interact to form a gel and component C is contained within the gel; wherein the weight ratio of component A to component B is from about 1:4 to about 1:2; wherein component A is selected from the group consisting of antioxidants, dispersants, succinics, maleic anhydride styrene copolymers, maleated ethylene diene monomer copolymers, surfactants, emulsifiers, functionalized derivatives of such components and combinations thereof; wherein component B is selected from the group consisting of dispersants, detergents, overbased detergents, carbon black, silica, alumina, titania, magnesium oxide, calcium carbonate, lime, clay, zeolites and combinations thereof; wherein component C is selected from the group consisting of antioxidants, extreme pressure agents, wear reduction agents, viscosity index improvers, anti-foaming agents and combinations thereof; and wherein the composition has a tan delta value of ≦0.75; wherein the gel components are controlled released during engine, operation resulting in the reduction of soot in the, engine oil and/or emission, in an engine exhaust.

20. An oil filter for an engine oil lubricating system comprising a housing, a filter for removing particulate matter from an oil bypass filter and a container of the gel composition of claim 1; wherein the use of the oil filter results in the reduction of one of the following selected from the group consisting of an engine soot, emission and combinations thereof.

21. A gel containment device for an engine oil lubricating system comprising a housing and a container of the gel composition of claim 1; wherein the use of the gel containment device results in soot reduction, emissions reduction or combinations thereof of an engine.

* * * * *